US010760264B2

(12) United States Patent
Zheng et al.

(10) Patent No.: US 10,760,264 B2
(45) Date of Patent: Sep. 1, 2020

(54) ASSEMBLING STRUCTURE OF PREFABRICATED CONCRETE COMPONENT

(71) Applicant: Hefei Construction Engineering Group Co.Ltd, Hefei (CN)

(72) Inventors: Zhitao Zheng, Hefei (CN); Guofu Liu, Hefei (CN); Gangyao Tu, Hefei (CN); Haisheng Zhu, Hefei (CN); Yuguo Wang, Hefei (CN)

(73) Assignee: HEFEI CONSTRUCTION ENGINEERING GROUP CO.LTD, Hefei (CN)

( * ) Notice: Subject to any disclaimer, the term of this patent is extended or adjusted under 35 U.S.C. 154(b) by 290 days.

(21) Appl. No.: 16/067,594

(22) PCT Filed: Feb. 27, 2018

(86) PCT No.: PCT/CN2018/077491

§ 371 (c)(1),
(2) Date: Jun. 30, 2018

(87) PCT Pub. No.: WO2019/148566

PCT Pub. Date: Aug. 8, 2019

(65) Prior Publication Data

US 2020/0232207 A1 Jul. 23, 2020

(30) Foreign Application Priority Data

Jan. 31, 2018 (CN) ..... 2018 1 0097160

(51) Int. Cl.
*E04B 1/41* (2006.01)
*E04B 1/04* (2006.01)

(52) U.S. Cl.
CPC ..... *E04B 1/4121* (2013.01); *E04B 1/043* (2013.01)

(58) Field of Classification Search
CPC ..... E01C 11/04; E01C 11/06; E04B 1/4121; E04B 1/043; E04B 2001/2684; E04B 1/41; E04B 1/4107; E04B 1/4114
(Continued)

(56) References Cited

U.S. PATENT DOCUMENTS 2,297,923 A * 10/1942 Strong ..... E04B 1/4121 264/278
4,342,981 A * 8/1982 Yagher, Jr. ..... H01H 37/765 174/152 R (Continued)

FOREIGN PATENT DOCUMENTS

CN 205935422 U 2/2017
CN 106677433 A 5/2017

(Continued)

*Primary Examiner* — Brian E Glessner
*Assistant Examiner* — Adam G Barlow
(74) *Attorney, Agent, or Firm* — Bayramoglu Law Offices LLC

(57) ABSTRACT

The present invention provides an assembling structure of prefabricated concrete components. The sleeve includes a non-grout connection section and a grout connection section. The steel frame includes an inner barbed structure and an outer barbed structure. The diameter of the channel surrounded by a plurality of inner barbed structures is smaller than the diameter of the second to-be-connected steel bar. The diameter of the contour surrounded by a plurality of outer barbed structures is larger than the diameter of the inner chamber of the grout connection section. The alignment device includes a lower bearer and an upper bearer. The upper bearer and lower bearer are both electromagnets. The same magnetic poles of the upper bearer and the lower bearer are oppositely arranged, and the upper bearer and the lower bearer are connected in series in the same circuit.

14 Claims, 8 Drawing Sheets

(58) Field of Classification Search
USPC ..... 52/295, 583.1, 698, 699, 704, 706, 707; 404/47–49, 51, 52, 54, 56, 60–63
See application file for complete search history.

(56) References Cited

U.S. PATENT DOCUMENTS 5,134,828 A * 8/1992 Baur ..... E04B 1/043 52/699
5,261,198 A * 11/1993 McMillan ..... E04G 21/142 52/125.5
5,309,691 A * 5/1994 Tolliver ..... E01D 19/125 138/155
5,366,672 A * 11/1994 Albrigo ..... B28B 23/043 264/219
5,606,839 A * 3/1997 Baumann ..... E04C 5/165 403/305
5,682,635 A * 11/1997 Tolliver ..... E01D 19/125 14/14
6,151,850 A * 11/2000 Sorkin ..... E04C 5/08 52/223.1
6,679,024 B2 * 1/2004 Dahl ..... E04C 5/165 29/437
6,761,002 B1 * 7/2004 Sorkin ..... E04C 5/12 403/374.1
7,533,505 B2 * 5/2009 Henderson ..... E02D 27/42 405/228
7,594,370 B2 * 9/2009 Clarke ..... E04B 2/702 52/586.1
9,617,694 B2 * 4/2017 Shaw ..... E01C 19/504
2011/0041447 A1 * 2/2011 Philipp ..... E04B 1/483 52/585.1

FOREIGN PATENT DOCUMENTS

CN 107366389 A 11/2017
WO 0104435 A1 1/2001

* cited by examiner

ASSEMBLING STRUCTURE OF PREFABRICATED CONCRETE COMPONENT

CROSS REFERENCE TO RELATED APPLICATIONS

This application is the national phase entry of International Application No. PCT/CN2018/077491, filed on Feb. 27, 2018, which is based upon and claims priority to Chinese Patent Application No. 201810097160.0, filed on Jan. 31, 2018, the entire contents of which are incorporated herein by reference.

TECHNICAL FIELD

The present invention pertains to the field of prefabricated construction technology of buildings, in particular to an assembling structure of prefabricated concrete components.

BACKGROUND

In the global context, it is imperative for the construction mode of the construction industry to develop toward prefabricated mode. The continuous improvement in the construction technology of the prefabricated concrete buildings offers technical foundations for improving the performance of the precast fabricated structure and realizing the housing industry. A prefabricated concrete structure is a concrete structure assembled by precast concrete components through a reliable connection, and then the prefabricated concrete structure, cast-in-place concrete, and cement-based grouting material form an entirety which is exactly the assembled monolithic concrete structure. The core and difficult point of the prefabricated construction is to ensure the connection quality of steel bars. It is hard to ensure the coaxial connection of the to-be-connceted steel bars with the available techniques and skills. At present, the connection of the precast components is commonly realized by pouring non-shrink or small-expansion cement-based grouting material to half-grout or full-grout sleeve. However, it is difficult to ensure that the sleeve is fully filled with grouting materials and the grout has low porosity with the available construction technology. Moreover, there are no effective technical means to detect the percentage of compaction of grouting in the specific engineering construction. Therefore, the development and use of prefabricated buildings in areas with high requirements of seismic fortification are restricted. In order to realize the universality of the prefabricated construction technology, it is necessary to targetedly improve the connection structure and construction skill regarding the above problems.

Since the full-grout sleeve has large geometric size, large grouting work load, high construction difficulty, and the range of steel bar critical region around the connection node is wide, the half-grout sleeve is commonly used in engineering at present. The widely used half-grout sleeve is an iron casting component. One end of the half-grout sleeve is directly connected to the steel bar bolt, and the other end is directly connected by the grout. In the construction site, the ribs on the steel bar must be fully removed. One end of the steel bar is subjected to cold-rolling to form screw thread, and then connected to the half-grout sleeve through thread connection. Such connection has the following drawbacks: (1) The procedure of processing thread on site is complex and the standard of quality is hard to be controlled. (2) When performing the thread connection on the construction site, the torque wrench must be used, which increases the operative difficulty. (3) The length of steel bar inserted into grout sleeve and the quality of thread connection should be controlled to satisfy the requirements of national standards, so it is extremely difficult to achieve a high qualification ratio. (4) According to the disclosure of prior art, for the half-grout connection structure, the number of ribs of the non-grout connection section and the side wall of the grout sleeve are increased to improve the strength of the connection part of the prefabricated concrete components, so that the sleeve wall is thick and heavy.

In addition, there are also half-grout sleeves, which are made by performing mechanical cutting process on steel rod or rolling process on finished seamless steel tube. For mechanical cutting process of steel rod, the cutting workload is large and the cost of processing is high, and the drawbacks of the above-mentioned connection construction of steel bar still exist. For example, a novel joint for cement grout rebar disclosed in Chinese patent CN102116075A is essentially a half-grout sleeve made by milling rolled profile steel.

Currently, the connection of the prefabricated concrete components mainly used is grout sleeve connection. The core and difficult point is to ensure the quality of steel bar connection of the prefabricated concrete components. It is difficult to ensure the coaxial connection of the steel bars in the grout sleeve with the available techniques and skills. According to statistics, in the engineering practice, the accurate connecting rate between the sleeve and the steel bar extending outward is about 20%, which is caused by the following reasons. (1) It is hard to insert the steel bars extending outward from the end of the same component into the corresponding sleeve, as a result the installation of the components is hard. (2) The steel bar of the grout connection section closely contacts the inner wall of the sleeve when being inserted into the grout sleeve, so in the subsequent step of grouting the steel bar of the grout connection section cannot be completely wrapped around by the grout. As a result, the connection strength of the sleeve greatly reduces, and the load transferring ability at the connection part of the components is seriously degraded.

In addition, after the assembly of the last prefabricated concrete structure is completed, the exposed steel bars may bend or get horizontally displaced due to grouting or other external reasons, so the grout sleeve of the next prefabricated concrete structure is not in the same vertical direction of the former one. Therefore, before assembly, steel bars need to be straightened and the horizontal position should be adjusted. In the prior art, such process is generally carried out by manually striking with the wrench or bending with the plier, so it is noisy while low accuracy is obtained.

SUMMARY

In order to solve the technical problems, the present invention provides an assembling structure of prefabricated concrete component, by which the objectives of fast assembling the prefabricated components, achieving high accuracy and high seismic performance can be realized.

The technical solutions used by the present invention to solve the foregoing problems are as follows.

An assembling structure of prefabricated concrete component includes a half-grout sleeve and an alignment device. The half-grout sleeve includes a sleeve, a steel tube transition section, and a self-locking steel frame. The sleeve includes a non-grout connection section and a grout connection section. A section of a tube body of the steel tube transition section is fixed inside the non-grout connection section, and another section of the tube body extends out of the non-grout connection section to form a rolling section connected to a first to-be-connceted steel bar by a rolling connection.

The steel frame includes longitudinal guide steel bars, tilted steel branches, and circular fixing steel rings. A plurality of longitudinal guide steel bars and a plurality of circular fixing steel rings form a cylindrical keel. A plurality of tilted steel branches are circumferentially and radially arranged along the cylindrical keel and are fixed slantwise. One end of the tilted steel branch is located inside the cylindrical keel to form an inner barbed structure. A plurality of inner barbed structures surround to form a channel for a second to-be-connceted steel bar to pass. The diameter of the channel is smaller than the diameter of the second to-be-connceted steel bar. Another end of the tilted steel branch is located outside the cylindrical keel to form an outer barbed structure. The diameter of the contour surrounded by the outer barbed structures is larger than the diameter of the inner chamber of the grout connection section. After the steel frame is inserted into the grout connection section, the outer barbed structures closely contact an inner wall of the grout connection section. The channel is coaxial with the steel tube transition section.

The alignment device includes a control mechanism, at least two sets of bearing mechanisms, and a positioning mechanism. The bearing mechanism includes a lower bearer and an upper bearer. The upper bearer and the lower bearer are both electromagnets. The positioning mechanism includes a first mark and a second mark respectively arranged at corresponding positions of the assembly surfaces of an upper concrete component and a lower concrete component. The lower bearer is placed at the first mark, and the upper bearer is placed at the second mark. The same magnetic poles of the upper bearer and the lower bearer are oppositely arranged. The upper bearer and the lower bearer are connected in series on a same circuit. The control mechanism controls the magnitude of a repulsive force between the upper bearer and the lower bearer by controlling the magnitude of the current of the circuit.

Preferably, the non-grout connection section is a truncated cone structure. The grout connection section is a cylindrical structure. A small diameter end of the non-grout connection section is connected to an end of the grout connection section, and the junction has a fillet transition.

Preferably, a section of tube body of the steel tube transition section is connected and fixed with the non-grout connection section by the thread connection.

Preferably, an end of the grout connection section away from the non-grout connection section is provided with a grout hole. Another end of the grout connection section extends to the non-grout connection section with an exhaust hole.

Preferably, an inner wall of the grout connection section is provided with a spiral raised rib. The spiral raised rib tilts from bottom to top toward a side away from the non-grout connection section. A side of the spiral raised rib away from the non-grout connection section is a concave arc surface, and another side is a convex arc surface. Two sides of the spiral raised rib and the inner wall of the grout connection section have a fillet transition.

Preferably, a plurality of anti-shear components are fixed on a cylinder wall of the grout connection section. The anti-shear components are simultaneously cured and fixed with grouting material inside the grout connection section and concrete outside the grout connection section.

Preferably, the upper bearer includes a support plate and a limit plate. The limit plate is vertically fixed at an end part of the support plate to form an L-shaped structure with the support plate. The support plate is located on the assembly surface of the upper concrete component. The limit plate is located on the side surface of the upper concrete component.

Preferably, the support plate and the lower bearer both have a hollow structure. An interior of the hollow structure is provided with a coil and an iron core passing through the coil. Both of the support plate and the lower bearer are provided with an incoming line port and an outgoing line port. An input terminal and an output terminal of the coil are connected to external circuit through the incoming line port and outgoing line port, respectively.

Preferably, the two adjacent upper bearers and/or two adjacent lower bearers are connected by a connection rod. The connection rod is a retractable rod.

Preferably, opposite sides of the two adjacent limit plates are respectively provided with an engaging slot, and the opposite sides of the two adjacent lower bearers are respectively provided with an engaging slot. Two ends of the connection rod are respectively provided with an engaging key matched with the engaging slot.

The invention has the following advantages.

(1) The grout sleeve, self-locking steel frame, and steel tube transition section of the present invention can be respectively processed and manufactured and then assembled subsequently, so these components can be mass-produced in a factory and it is easy to control the quality of the various components to meet the industry standards. By using the principle of magnetic suspension, the steel bars of upper and lower concrete components can be aligned with each other quickly and accurately, so it can save time and labor. By using the serially connected circuit, the magnetic forces of the plurality of sets of bearing mechanisms are the same, so the supporting stability can be ensured.

(2) In the present invention, the grout sleeve is indirectly connected to the first to-be-connected steel bar, namely, first the grout sleeve and the steel tube transition section are fixedly connected to each other through threads, then the first to-be-connected steel bar is inserted into the grout sleeve via the steel tube transition section, and the first to-be-connected steel bar is connected to the steel tube transition section in a rolling manner. In this process, the connection of the grout sleeve and the steel tube transition section is completed by mechanical operation in the factory, so it is easy to control the quality of the thread connection. Moreover, since the first to-be-connected steel bar is directly connected to the steel tube transition section by the rolling manner without the need to fully remove the ribs on the steel bar and process the threads, so the process is simple, and the length of the steel bar inserted into the sleeve can be easily controlled.

(3) The inner wall of the grout sleeve is provided with the spiral raised rib. One side of the spiral raised rib is provided with concave arc surface which can guide the grouting material. The other side is a convex arc transition which is helpful for the grouting material to move smoothly in the grout sleeve, without the phenomenon of throttling and bubbling of the grouting material caused by the annular raised rib inside the traditional grout sleeve. Therefore, a close contact of the grouting material and the inner wall of the grout sleeve is ensured, and the grout has low porosity. Moreover, the spiral raised rib can also increase the contact area between the grout sleeve and the grouting material, so that the anti-shear strength of the connection part of the prefabricated concrete components is increased.

(4) Since a self-locking steel frame is configured in the grout sleeve, when the second to-be-connected steel bar is inserted into the grout sleeve, the inner barbed structure formed by the tilted steel branch is stuck on the ribs of the second to-be-connected steel bar, and the outer barbed structure is stuck on the spiral raised rib on the inner wall of the grout sleeve. Therefore, action force and reaction force are formed in the tilted steel branch to prevent the second to-be-connected steel bar from being pulled out, so the stability of the prefabricated concrete component can be immediately maintained after the hoisting of the prefabricated concrete component is finished.

(5) In the present invention, a self-locking steel frame is added to the grout connection section and covered on the second to-be-connected steel bar, so that the strength of the grout connection part of the prefabricated concrete components is improved, thereby reducing the thickness of the sleeve wall and the weight of the grout sleeve.

(6) The self-locking steel frame arranged in the grout sleeve has 4-8 tilted steel branches on the same section. one end of the 4-8 tilted steel branches forms a circular section which can limit the position of the second to-be-connected steel bar in the grout sleeve, so that the coaxial connection of the second to-be-connected steel bar and the first to-be-connected steel bar can be ensured.

(7) The present invention increases the ability to resist shear force of the structure. It also increases the contact area between the grout sleeve and the surrounding concrete, and the anti-shear ability of the connection part of the prefabricated concrete components. In addition, in the production stage of the present invention, the self-locking steel frame is first installed, and the high-strength bolt is subsequently installed. The high-strength bolt extended into the grout sleeve can prevent the self-locking steel frame from being pulled out of the grout sleeve.

(8) The intersecting surface between the conical structure and the cylindrical structure of the grout sleeve is provided with an eccentric exhaust hole extending to the side wall of the non-grout connection section. Such structure can ensure that the grout sleeve is filled with grouting material when the vertical steel rod connection of the prefabricated concrete component is performed.

(9) In addition, as a result of the retractable connection rod, the distance between two adjacent upper bearers or two adjacent lower bearers can be locked to avoid the relative horizontal displacement. Since, the connection rod is designed with a hollow structure, a wiring channel is offered, so the construction site may look well-organized while the safety of using electricity can be ensured at the same time. The connection rod is connected to two adjacent upper bearers or two adjacent lower bearers through a snap-fit structure, so it is convenient to assemble and disassemble.

DETAILED DESCRIPTION OF THE EMBODIMENTS

In order to have a better understanding of the structural characteristics and the effects that the present invention can achieve, the preferred embodiments of the present invention will be described in detail with reference to the drawings hereinafter.

Embodiment 1

Figure 1:
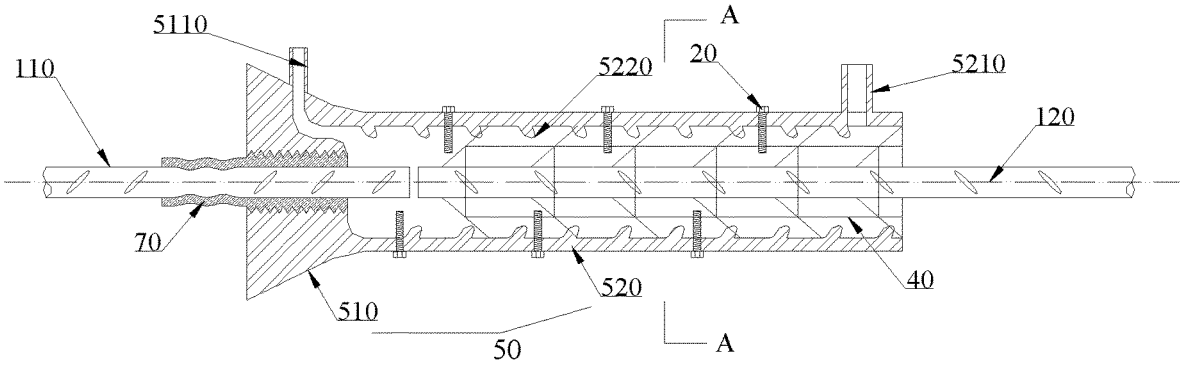
FIG. 1 is an axially sectional schematic diagram showing the structure of a connection of a half-grout sleeve and a first to-be-connected steel bar, a second to-be-connected steel bar according to embodiment 1 of the present invention.
Figure 2:
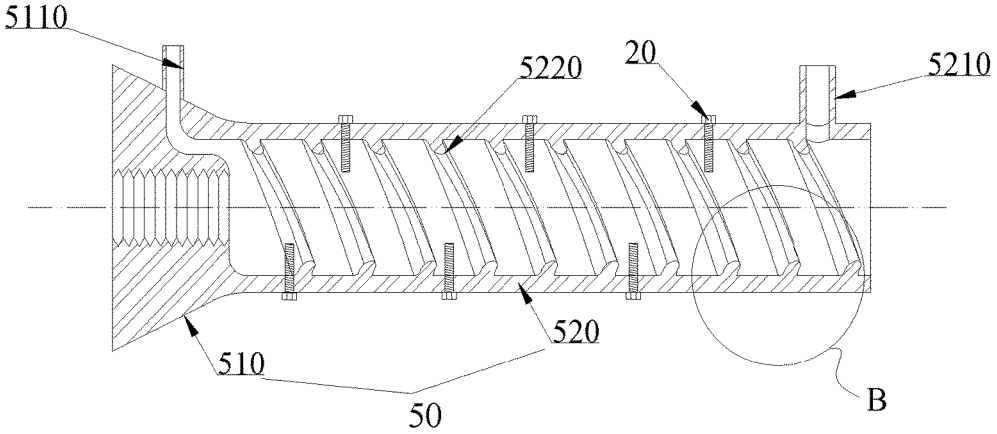
FIG. 2 is an axially sectional schematic diagram showing the structure of the half-grout sleeve according to embodiment 1 of the present invention.
Figure 3:
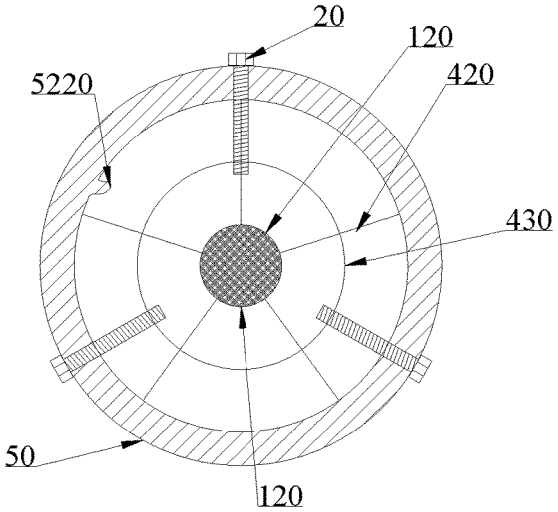
FIG. 3 is a sectional structural schematic diagram along A-A of FIG. 1.

As shown in FIG. 1, FIG. 2, and FIG. 3, an assembling structure of prefabricated concrete components includes a sleeve 50, a steel tube transition section 70, and a self-locking steel frame 40.

The sleeve 50 includes a non-grout connection section 510 and a grout connection section 520. The non-grout connection section 510 is a truncated cone structure. The grout connection section 520 is a cylindrical structure. A small-diameter end of the non-grout connection section 510 is connected to one end of the grout connection section 520, and the connection point has a fillet transition. An end of the grout connection section 520 away from the non-grout connection section 510 is provided with a grout hole 5210, and an other end of the grout connection section 520 extends toward the non-grout connection section 510 with an exhaust hole 5110. Specifically, the exhaust hole 5110 may be an air hole arranged in the cone of the non-grout connection section 510 which goes vertically first, then horizontally, and the air hole is connected to the inner chamber of the grout connection section 520. By doing so, the grouting material can reach the front end of the grout connection section 520 in the grouting. In order to ensure a sufficient grouting, the present embodiment can also be designed as the exhaust hole 5110 having a smaller diameter than that of the grouting hole 5210, so that the grouting amount is greater than the overflow amount, thereby ensuring that the grout filled in the grout connection section 520 is sufficient.

Figure 7:
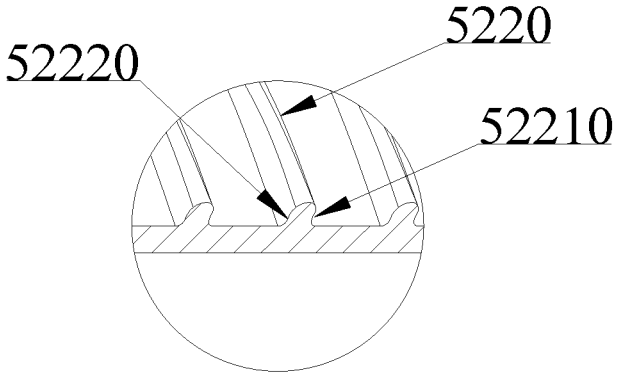
FIG. 7 is a partially enlarged view of part B in FIG. 2.

As shown in FIG. 7, the inner wall of the grout connection section 520 is further provided with a spiral raised rib 5220. The raised rib 5220 tilts from bottom to top towards the side away from the non-grout connection section 510. One side of the raised rib 5220 away from the non-grout connection section 510 has a concave arc surface 52210, and the other side has a convex arc surface 52220. Both sides of the raised rib 5220 and the inner wall of the grout connection section 520 have fillet transition. The angle between the spiral tangent and the center line of the sleeve 50 is ranged from 25° to 60°. The height of the spiral raised rib 5220 is ranged from 4 mm to 6 mm.

The cylinder wall of the grout connection section 520 is provided with a plurality of mounting holes for fixing the anti-shear components 20. The anti-shear components 20 are fixed on the grout connection section 520 through the mounting holes. The mounting holes may be arranged as a quincunx shape, but not limited to such manner. The anti-shear component 20 may have various forms. For example, the anti-shear component 20 may be a bolt fixed on the grout connection section 520. The nut of the bolt is located outside the cylinder wall of the grout connection section 520 and is cured and fixed with the external concrete. The screw passes through the cylinder wall to the inside and is cured and fixed with the grouting material 130 inside the cylinder. Also, the anti-shear component 20 may be a platy structure arranged in the cylinder wall. The platy structure is partly outside the cylinder and partly inside the cylinder. Since the anti-shear component 20 is cured and fixed with the grouting material 130 inside the grout connection section 520 and the external concrete, the objective of improving the anti-shear ability of the concrete components after assembly can be achieved.

Figure 6:
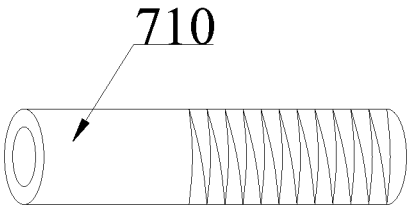
FIG. 6 is a structural schematic diagram of a steel tube transition section according to embodiment 1.

As shown in FIG. 6, one section of tube body of the steel tube transition section 70 is provided with external threads, while the inner surface of the non-grout connection section 510 is provided with internal threads. The steel tube transition section 70 and the non-grout connection section 510 are fixed by thread connection. The other section of tube body of the steel tube transition section 70 extends out of the non-grout connection section 510 to form a rolling section 710 connected to a first to-be-connected steel bar in a rolling manner.

Figure 4:
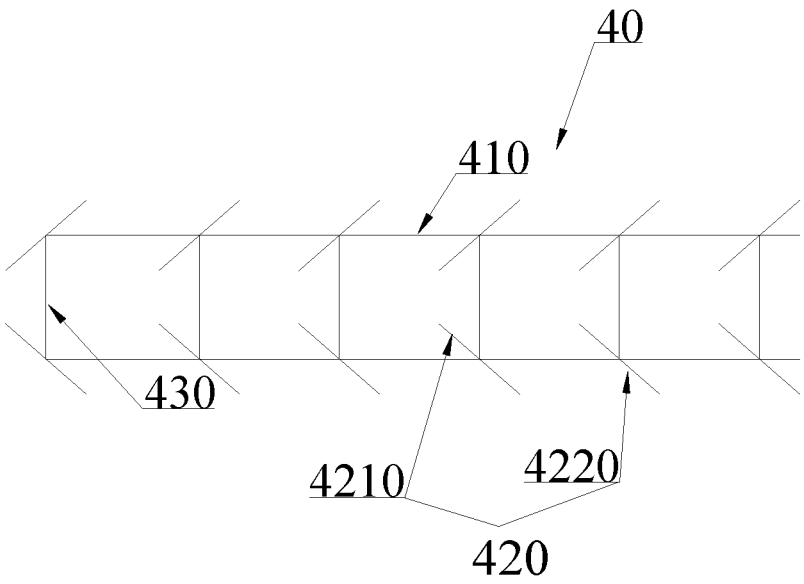
FIG. 4 is an axially sectional schematic diagram showing the structure of steel frame 40 according to embodiment 1.
Figure 5:
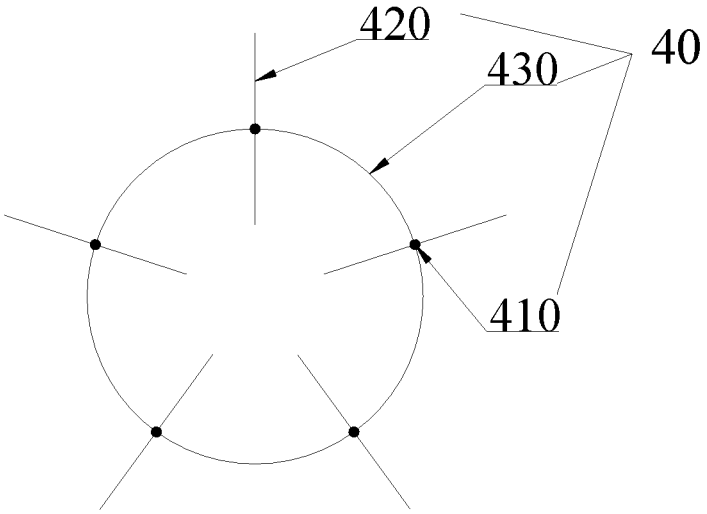
FIG. 5 is a right schematic view of FIG. 4.

As shown in FIG. 4 and FIG. 5, the steel frame 40 includes longitudinal guide steel bars 410, tilted steel branches 420, and annular fixing steel rings 430. A plurality of longitudinal guide steel bars 410 are fixed by a plurality of annular fixing steel rings 430 to form a cylindrical keel. A plurality of tilted steel branches 420 are circumferentially and radially arranged along the keel and fixed slantwise. One end of the tilted steel branch is located inside the keel to form an inner barbed structure 4210. A plurality of inner barbed structures 4210 surround to form a channel for a second to-be-connceted steel bar to pass. The diameter of the channel is smaller than the diameter of the second to-be-connceted steel bar. The other end of the tilted steel branch is located outside the keel to form an outer barbed structure 4220. The diameter of the contour surrounded by the outer barbed structures 4220 is larger than the diameter of the inner chamber of the grout connection section 520. After the steel frame 40 is inserted into the grout connection section 520, the outer barbed structure 4220 closely contact an inner wall of the grout connection section 520 to prevent the steel frame 40 from being pulled out from the grout connection section 520 by external force. The channel is coaxial with the steel tube transition section 70, so that when the second to-be-connected steel bar 120 is inserted, it is easy to realize the alignment with the first to-be-connected steel bar 110. Moreover, since the inner barbed structure 4210 abuts against the rib on the second to-be-connected steel bar 120, the second to-be-connected steel bar 120 is prevented from being pulled out from the steel frame 40 under external force.

In the present embodiment, the plurality of longitudinal guide steel bars 410 are uniformly distributed along the circumferential direction of the annular fixing steel ring 430. The tilted steel branches 420 are fixed to a plurality of annular sections of the keel. Each section may be uniformly distributed with 4-8 tilted steel branches 420, but not limited to such manner. The tilted steel branches may be irregularly arranged, as long as the function of alignment and anti-pulling can be realized. In the present embodiment, the middle part of the tilted steel branch 420 is welded with the keel. A half of the branch body is inside the keel, and a half of the branch body is outside the keel. The tilted steel branch 420 serves as inner barbed structure 4210 and outer barbed structure 4220 half-and-half, so the strength of inner barbed structure 4210 and outer barbed structure 4220 is basically the same.

As shown in FIG. 1 and FIG. 6, in the present invention, the first to-be-connected steel bar 110 is connected to the rolling section 710 of the steel tube transition section 70 in a rolling manner. The steel tube transition section 70 is connected to the grout sleeve 50 by a thread connection. The interaction of the high-strength bolt on the grout sleeve 50 and the self-locking steel frame 40, the grouting material 130, and the second to-be-connected steel bar 120 inside the grout sleeve allows the concrete, the grout sleeve 50, the grouting material 130, and the second to-be-connected steel bar 120 to form an integral entirety. Therefore, the connection of the second to-be-connected steel bar 120 and the prefabricated concrete components can be realized. The three seismic fortification standards of "no damage in minor earthquake, repairable in moderate earthquake, no collapse in severe earthquake" can be satisfied. It can be widely applied in the steel bar connection of various kinds of prefabricated concrete components.

Embodiment 2

A processing method of an assembling structure of prefabricated concrete components includes the following steps.

Step 1. Processing Grout Sleeve 50

The grout sleeve 50 is processed by casting method to form an integral body. One end of the grout sleeve 50 is provided with internal threads, and the cylinder body is configured with a plurality of mounting holes, then standby;

Step 2. Processing the Steel Tube Transition Section 70

A steel tube with appropriate length and thickness is selected as the steel tube transition section 70. One end of the steel tube transition section 70 is provided with external thread and standby.

Step 3. Processing the Self-Locking Steel Frame 40

First, a plurality of longitudinal guide steel bars 410 and a plurality of annular fixing steel rings 430 are welded to form a cylindrical keel. Subsequently, a plurality of tilted steel branches 420 are radially and slantwise welded on a plurality of annular sections of the keel to form an inner barbed structure 4210 and an outer barbed structure 4220, and standby;

Step 4. Assembly

First, the steel tube transition section 70 is fixed with the sleeve 50 by thread connection. Then, the self-locking steel frame 40 is inserted into the sleeve 50 from the end away from the steel tube transition section 70. Finally, the anti-shear components are installed into the mounting holes.

Embodiment 3

A processing method of a prefabricated concrete component includes the following steps.

Step 1. Binding the Steel Frame of the Prefabricated Concrete Components

One end of the first to-be-connected steel bar 110 is bound and fixed with other steel bars to form a steel bar frame of the prefabricated concrete components. The other end of the first to-be-connected steel bar is inserted into the rolling section 710 of the steel tube transition section 70, and the connection between the steel tube transition section 70 and the first to-be-connected steel bar 110 is realized by a rolling equipment. Thus, the self-locking half-grout sleeve 50 is preinstalled in the steel bar frame of the prefabricated concrete components.

Step 2. Formation of the Prefabricated Concrete Component

The plastic pipe 80 is connected to the grouting hole 5210 and the exhaust hole 5110 on the side wall of the sleeve 50 and led to outside of the component mould plate. Subsequently, the concrete spreader begins to pour the concrete. After vibrating and compacting by the vibration platform, the processing and manufacturing of the prefabricated concrete component is finished.

Step 3. Mould Removal, Storage

The prefabricated concrete component can proceed with mould removal and storage after maintenance.

Embodiment 4

Figure 8:
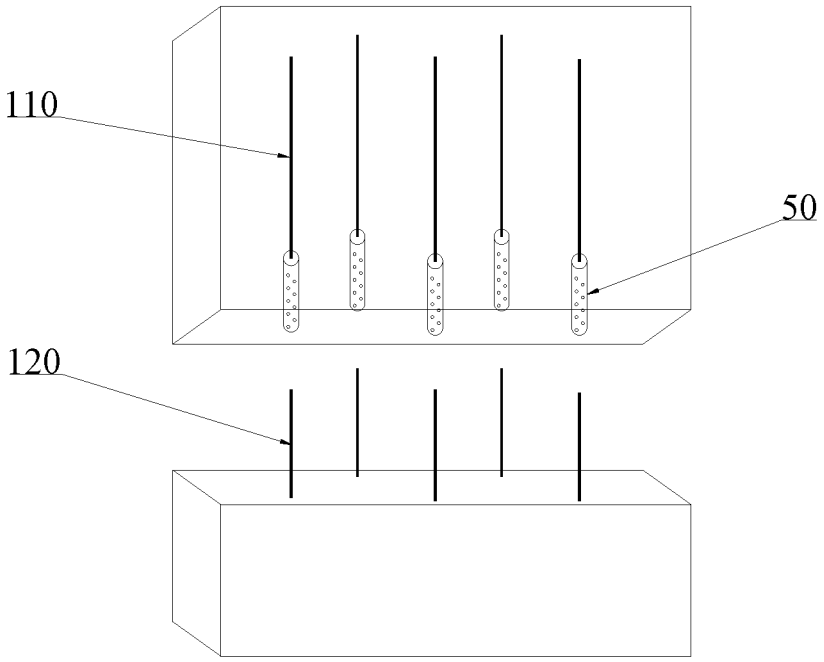
FIG. 8 is a schematic diagram showing the assembling structure of the prefabricated concrete components according to embodiment 4.
Figure 9:
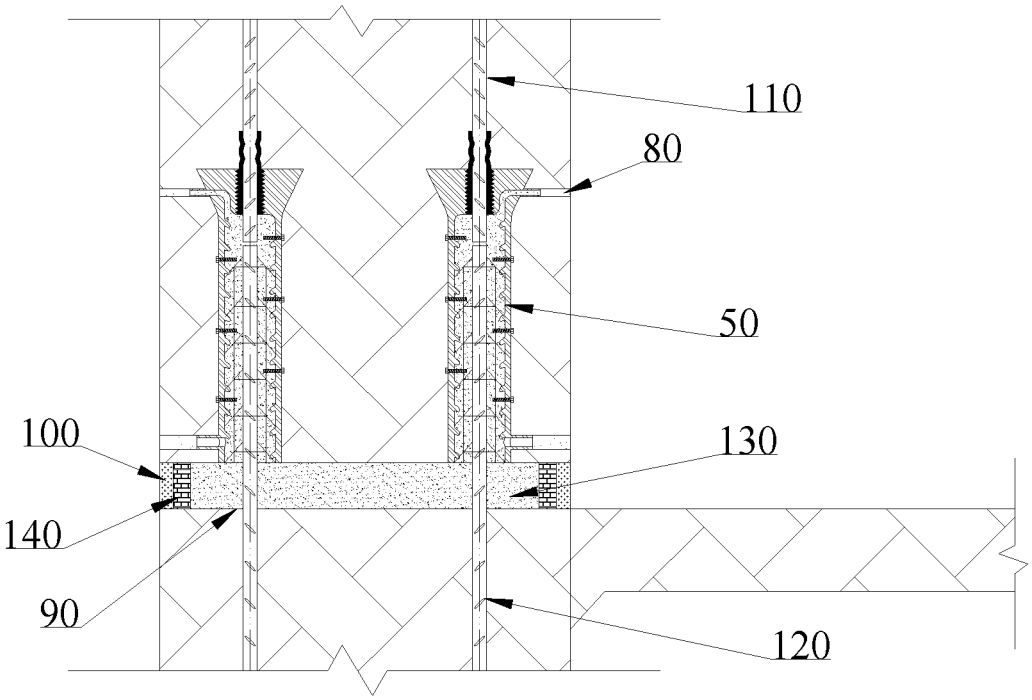
FIG. 9 is a schematic diagram showing the grouting structure of the prefabricated concrete components according to embodiment 4.

FIG. 8 and FIG. 9 show an on-site installation method of prefabricated concrete components.

Step 1. Installation preparation: before the hoisting of the prefabricated concrete component, the tools and materials needed for grouting should be prepared, the foundation surface of the connection part should be cleaned up, and the horizontal position and reserved length of the second to-be-connected steel bar 120 and the hoisting equipment should be checked. If the horizontal position of the second to-be-connected steel bar 120 does not meet the design requirements, the horizontal position should be adjusted by a pre-prepared horizontal position adjusting device for the steel bar of the prefabricated concrete component (see embodiment 7 for details), and the elevation control value is determined according to the on-site setting-out. The adjustable heel block 200 is placed on the foundation surface of the connection part to adjust the height in the subsequent installation of the prefabricated concrete components.

Step 2. Hoisting: the installation and positioning operation of upper and lower concrete components are completed by using a magnetic suspension connection positioning device for the steel bars of the prefabricated concrete components (see embodiment 5 for details) and a magnetic suspension connection positioning method for the steel bars of the prefabricated concrete component (see embodiment 6 for details). By doing so, the second to-be-connected steel bars 120 of the lower concrete component are correspondingly insert into the grout sleeve 50 of the upper concrete component in one-to-one manner.

Step 3. Correcting and fixing installation position: the sway brace of the prefabricated concrete component is installed and fixed, and the perpendicular degree of the prefabricated concrete component is corrected.

Step 4. Sealing the grout connection area: since the adjustable heel block 200 is placed on the foundation surface of the connection part, a grout connection area is formed between the foundation surface of the connection part and the prefabricated concrete component. Rubber strip 140 and the bed mortar 100 are used to seal around the grout connection area. The rubber strips 140 serve as an interlayer. In one aspect, rubber strips can be used as a separation layer between the bed mortar 100 and the grouting material 130. In another aspect, rubber strips are helpful in controlling the smearing depth of the bed mortar 100. The grout connection area and the inner space of respective grout sleeve 50 form a communicated grout chamber 90.

Figure 10:
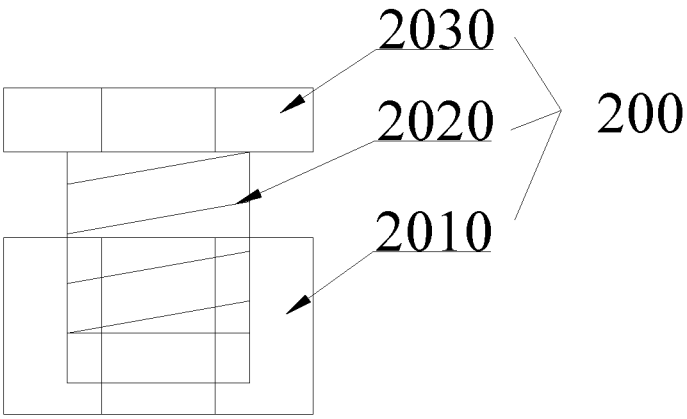
FIG. 10 is a structural schematic diagram of a heel block according to embodiment 4.
Figure 11:
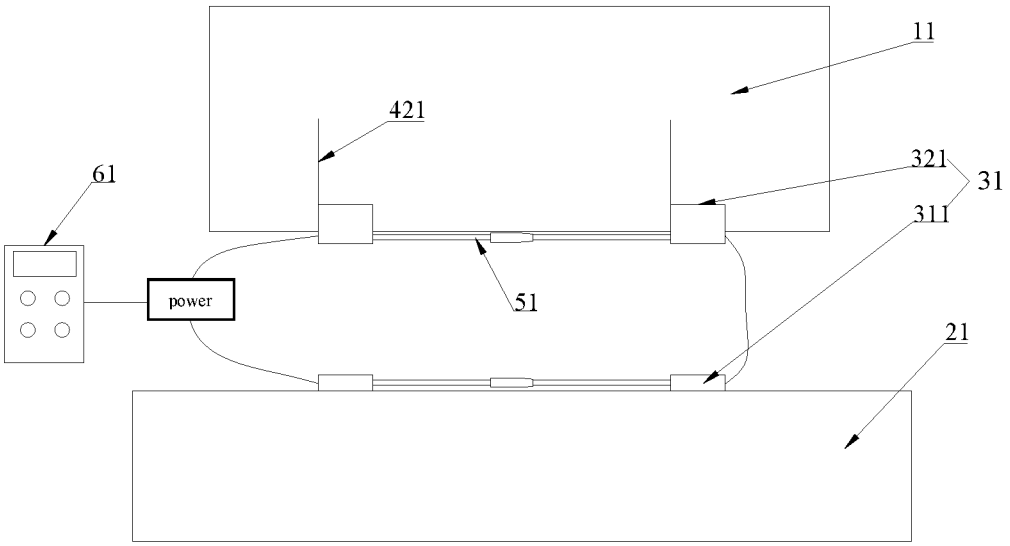
FIG. 11 is a schematic diagram showing the overall structure according to embodiment 5 of the present invention.
Figure 12:
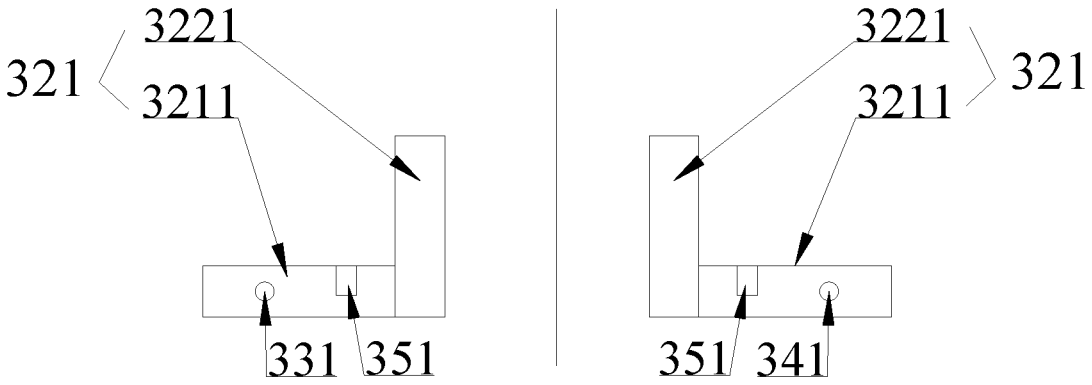
FIG. 12 is a schematic diagram showing the upper bearers arranged in a mirror structure at the left and right according to embodiment 5 of the present invention.
Figure 13:
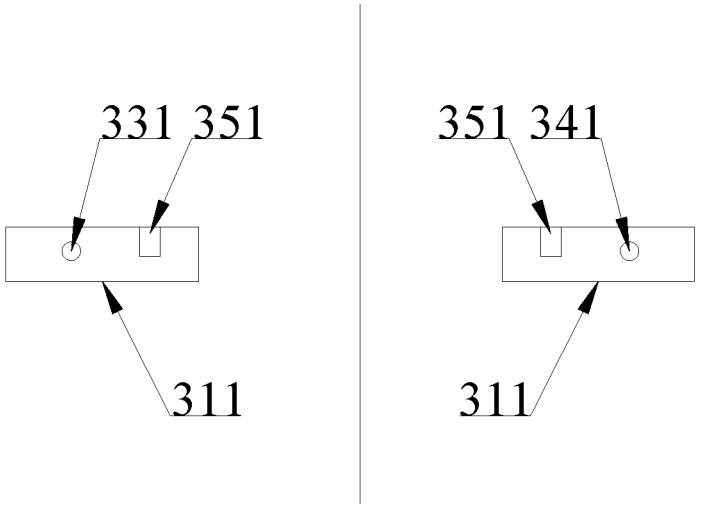
FIG. 13 is a schematic diagram showing the lower bearers arranged in a mirror structure at the left and right according to embodiment 5 of the present invention.
Figure 14:
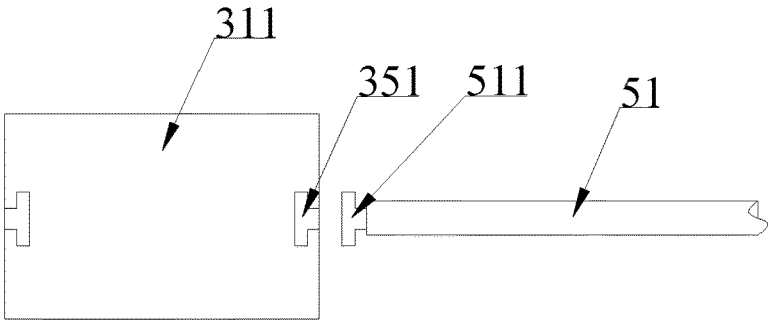
FIG. 14 is a top schematic view showing the connection between the lower bearer or the support plate and the connection rod according to embodiment 5 of the present invention.
Figure 15:
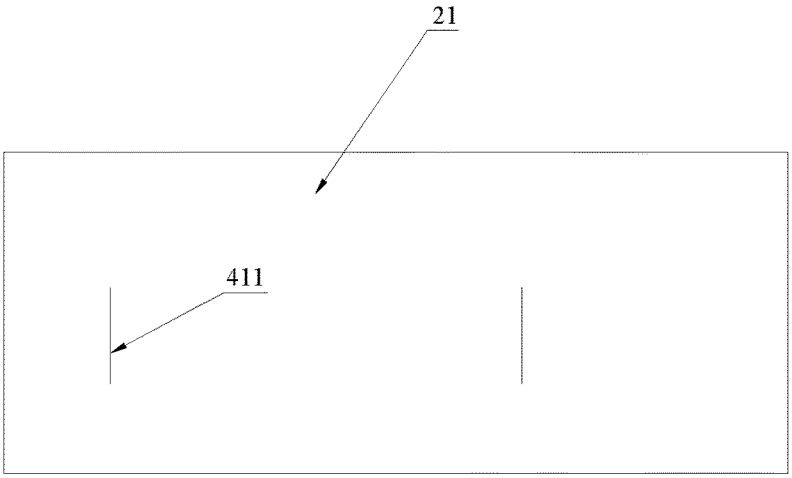
FIG. 15 is a top schematic view showing the structure of the lower concrete component according to embodiment 5 of the present invention.
Figure 16:
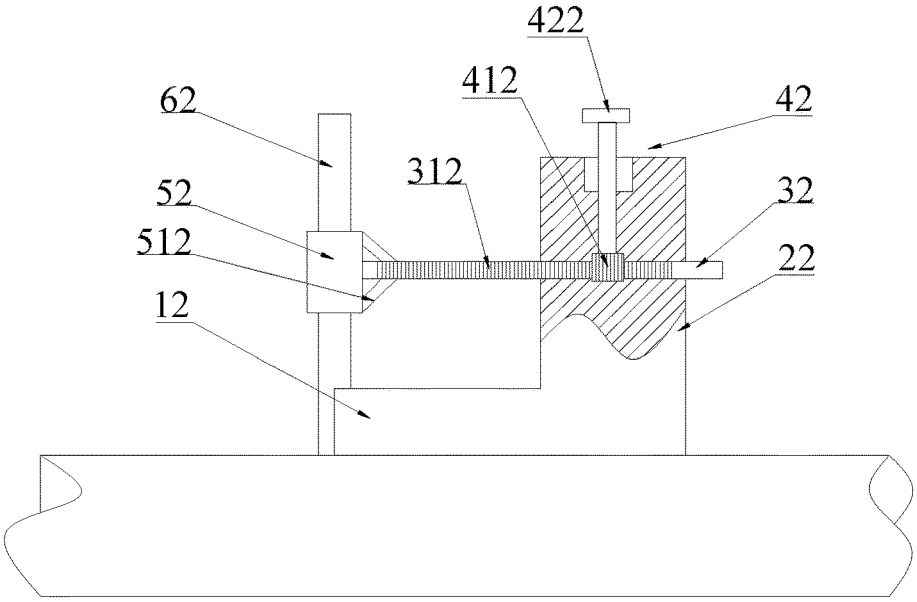
FIG. 16 is a sectional schematic diagram showing the structure of an adjusting device according to embodiment 7 of the present invention.
Figure 17:
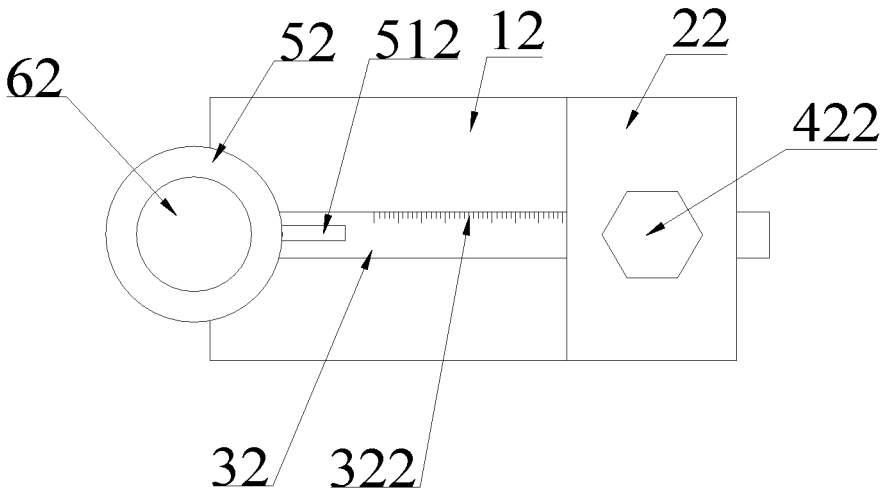
FIG. 17 is a top structural schematic view of FIG. 16.
Figure 18:
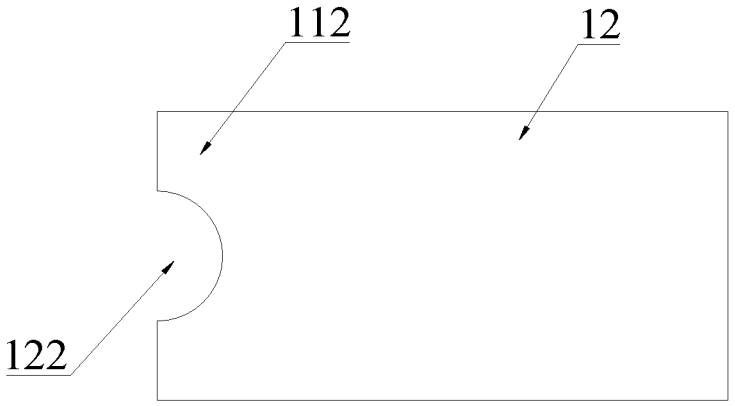
FIG. 18 is a top schematic view showing the structure of a base according to embodiment 7 of the present invention.
Figure 19:
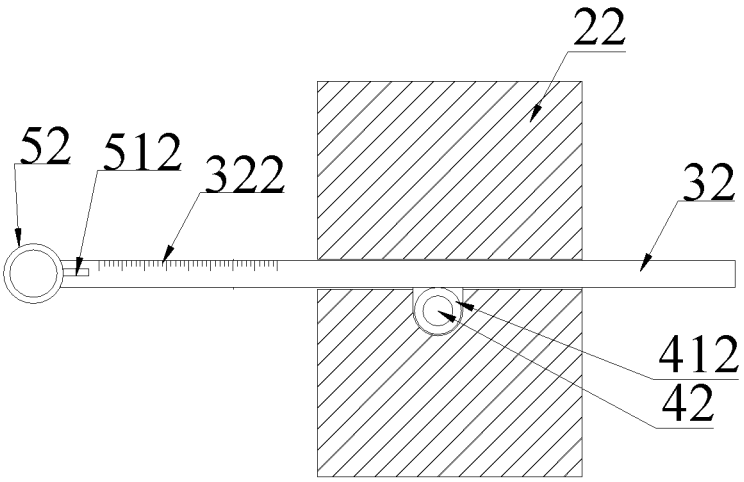
FIG. 19 is a top structural schematic view of the horizontal profile of the cushion cap according to embodiment 7 of the present invention.

As shown in FIG. 10, the adjustable heel block includes a base 2010. The base 2010 is configured with a screw hole. A screw 2020 is fixed in the screw hole. A gasket 2030 is fixed on the top of the screw 2020. The gasket 2030 is driven to go up and down by rotating the screw 2020, so as to achieve the objective of adjusting the height of the heel block 200.

Step 5. Grouting: after the specified maintenance time of the bed mortar 100 is reached, a grouting hole 5210 on the prefabricated concrete component is selected. The grout is fed into the sleeve 50 by a grout pump in a pressure grouting manner. When the grouting material 130 overflows from the exhaust hole 5110, the exhaust hole 5110 is plugged by a plug in time. When plugging, the grouting pressure of the grout pump is maintained to feed grout into the sleeve 50. The grouting material 130 enters the other grout sleeves 50 through the grout connection area. When the grouting material 130 overflows from the other grouting holes 5210 and exhaust holes 5110, the holes are plugged in time until the grouting material 130 overflows from all the grouting holes 5210 and the exhaust holes 5110 and the holes are tightly plugged, the grouting is stopped. After that, the grout pump is pulled out from the grouting hole 5210 which should also be immediately plugged. At the moment, the communicated grout chamber 90 is filled with the grouting material 130, and the grouting operation is completed.

Step 6. Maintenance: after the specified maintenance time of the grouting material 130 is reached, the installation of the prefabricated concrete components is realized.

Embodiment 5

FIGS. 1-5 show a magnetic suspension connection positioning device for steel bars of prefabricated concrete components, which is used to position an upper concrete component 11 and a lower concrete component 21, so as to make the non-grout connection steel bar in the upper concrete component 11 and the grout connection steel bar in the lower concrete component 21 coaxial.

The positioning device includes a control mechanism 61, at least two sets of bearing mechanisms 31, and a positioning mechanism 41. The bearing mechanism 31 includes a lower bearer 311 and an upper bearer 321. The upper bearer 321 includes a support plate 3211 and a limit plate 3221. The limit plate 3221 is fixed perpendicular to an end part of the support plate 3211 to form an L-shaped structure with the support plate 3211. The support plate 3211 and the lower bearer 311 are both electromagnets. The positioning mechanism 41 includes a first mark 411 and a second mark 421 respectively arranged at the corresponding positions of an assembly surface of the upper concrete component 11 and the lower concrete component 21. The lower bearer 311 is placed at the first mark 411 and the upper bearer 321 is placed at the second mark 421. The same magnetic poles of the support plate 3211 and the lower bearer 311 are oppositely arranged to form a repulsive force so as to make the upper bearer 321 suspended.

In order to ensure that different sets of bearing mechanisms 31 have the same magnetic force, the coils inside a plurality of support plates 3211 and lower bearers 311 are connected in series in the same circuit in the present embodiment. The magnitude of current of the circuit is controlled by the control mechanism 61 to adjust the magnitude of magnetic force between the support plate 3211 and the lower bearer 311, so as to adjust the magnitude of repulsive force between the support plate 3211 and the lower bearer 311.

An upper surface of the support plate 3211 is processed with an anti-slip treatment. An anti-slip layer closely contacts the assembly surface of the upper concrete component 11 i.e. the lower surface thereof. The limit plate 3221 is located at the side surface of the upper concrete component 11. The lower bearer 311 has the same shape and area as the support plate 3211. A lower surface of the lower bearer 311 is processed with the anti-slip treatment. The anti-slip layer closely contacts the assembly surface of the lower concrete component 11, i.e. the upper surface thereof. The anti-slip layer can be a rubber layer fixed on the upper surface of the support plate 3211 and the lower surface of the lower bearer 321, or an anti-slip structure directly compressed and formed on the upper surface of the support plate 3211 and the lower surface of the lower bearer 311. The inside of the support plate 3211 and the lower bearer 311 has a hollow structure, and a coil and an iron core passing through the coil are fixed therein. The support plate 3211 and the lower bearer 311 are respectively provided with an incoming line port 331 and an outgoing line port 341. An input terminal and an output terminal of the coil are respectively connected to the circuit through the incoming line port 331 and the outgoing line port 341. In order to ensure that the plurality of sets of bearing mechanisms 31 have the same magnetic force, all of the support plates 3211 and lower bearers 311 are connected in series in the same circuit.

In order to ensure that no relative displacement occurs between two adjacent upper bearers 321 and two adjacent lower bearers 311, in the present embodiment, the two adjacent upper bearers 321 and/or the two adjacent lower bearers 311 are connected by a connection rod 51. The specific structure is described below.

The opposite sides of the limit plates 3221 of the two adjacent upper bearers 321 are provided with engaging slots 351. Similarly, the opposite sides of the two adjacent lower bearers 311 are also provided with engaging slots 351. The two ends of the connection rod 51 are provided with engaging keys 511 matching with the engaging slots 351. The engaging key 511 is engaged with the engaging slot 351, so the distance between the two adjacent upper bearers 321 or the two adjacent lower bearers 311 is fixed.

In order to be applicable to different types of concrete components, in the present embodiment, the connection rod 51 is retractable, which can be directly purchased from the market and then processed with the engaging keys 511 at the two ends of the retractable rod.

In the present embodiment, the connection rod 51 is configured to have a hollow structure to serve as a wiring channel for the wire between two adjacent upper bearers 321 and/or lower bearers 311.

In the present embodiment, the magnitude of the current of the circuit is controlled by the control mechanism 61. The control mechanism 61 may be a control handle, which is provided with a plurality of current control buttons, and each button corresponds to a different current. Different levels of the current control buttons can be set according to different types of precast concrete components to achieve one-click control rapidly and accurately.

Embodiment 6

A magnetic suspension connection positioning method for steel bars of prefabricated concrete components includes the following steps.

Step 1. Marking: at least two first marks 411 are respectively arranged on the assembly surface of the lower concrete component 21, and second marks 421 having the same number and corresponding to the positions of the first marks 411 are arranged on the side wall of the upper concrete component 11.

Step 2. Rough alignment: first, the upper concrete component 11 is hoisted to a predetermined position, then the upper and lower concrete components are roughly aligned. Meanwhile, the lower bearer 311 and the upper bearer 321 are respectively placed at the first mark 411 and the second mark 421. The support plate 3211 on the upper bearer 321 and the lower bearer 311 are both electromagnets, and the same magnetic poles are placed oppositely. The coils inside the lower bearer 311 and the support plate 3211 are connected in series in the same circuit. Two adjacent upper bearers 321 are connected by the connecting rod 51, so are the two adjacent lower bearers 311.

Step 3. Accurate alignment: the on and off of the circuit are controlled by the control mechanism 61. The current is adjusted to an appropriate magnitude according to the type of the upper concrete component 11, so as to make the repulsive force between the support plate 3211 and the lower bearer 311 equal to the gravity of the upper concrete component 11, and the sling is in a relaxed state. Concurrently, the support plate 3211 is aligned with the lower bearer 311 under the action of magnetic force, such that the accurate alignment between the upper concrete component 11 and the lower concrete component 21 is completed.

Step 4. Installation: after the upper concrete component 11 is accurately aligned and stabilized, the magnetic force of the support plate 3211 and the lower bearer 311 is adjusted to uniformly and gradually decrease by controlling the current magnitude through the control mechanism 61, so as to make the gravity of the upper concrete component 11 greater than the repulsive force between the support plate 3211 and the lower bearer 311. Under the action of gravity, the upper concrete component 11 falls down slowly with a constant speed to a predetermined position. During this process, the sling always keeps a relaxed state. Finally, the upper concrete component 11 falls down to the adjustable heel block 200 on the lower concrete component 21. At the moment, the grout connection steel bars on the lower concrete component 21 are inserted into the sleeve of the upper concrete component, and coaxially connected to the non-grout connection steel bar at the other end of the sleeve of the upper concrete component 11.

Step 5. Removal: the upper bearer 321 and the lower bearer 311 of the present invention are removed to complete the installation and positioning operation of the upper and lower concrete components.

Embodiment 7

FIGS. 16-19 show a horizontal position adjustment device for steel bars of prefabricated concrete components which includes a base 12. The base 12 has a platy structure. A cushion cap 22 is fixed at one end of the base, and the other end of the base is a contacting end 112. The cushion cap 22 generally has a rectangular prism like or cylindrical structure. The cushion cap 22 is arranged perpendicular to the base 12.

The cushion cap 22 is provided with a horizontal through hole and a vertical through hole. A pull rod 32 passes through the horizontal through hole. A drive rod 42 is rotatably fixed in the vertical through hole, for example, the drive rod 42 is generally fixed in the vertical through hole through a bearer. A sleeve 52 for sleeveing around the steel bar is fixed at one end of a pull rod 32 that has the same orientation as the contacting end 112.

The body of the pull rod 32 is provided with a rack 312 which is generally arranged on the side surface of the pull rod 32. A gear 412 meshing with rack 312 is arranged at the bottom of the drive rod 42. An accommodating chamber is formed at the intersection of the horizontal through hole and the vertical through hole, and the gear 412 is located in the accommodating chamber and meshed with the rack 312. By rotating the drive rod 42, under the action of the engagement of gear 412 and rack 312, the pull rod 32 is driven to move forward or backward.

In order to prevent a misalignment between the contacting end 112 and steel bar, in the present embodiment, an arc opening 122 for limiting the body of the steel bar 62 is provided at the contacting end 112.

In order to facilitate the rotation of the drive rod 42, in the present embodiment, an operation handle 422 is fixed at the top of the drive rod 42.

In order to facilitate the control and adjustment of accuracy, in the present embodiment, the upper surface of the pull rod 32 is also provided with a ruler 322.

In order to improve the connection strength between the pull rod 32 and the sleeve 50, in the present embodiment, the connection point between the pull rod 32 and the sleeve 52 is provided with a reinforcing rib 512.

In order to facilitate the bending of the steel bar 62, in the present embodiment, the bottom end of the sleeve 52 is configured with a certain height difference from the upper surface of the base to reserve a stress concentration section for the bending of the steel bar, which is helpful in the bending operation.

Figure 20:
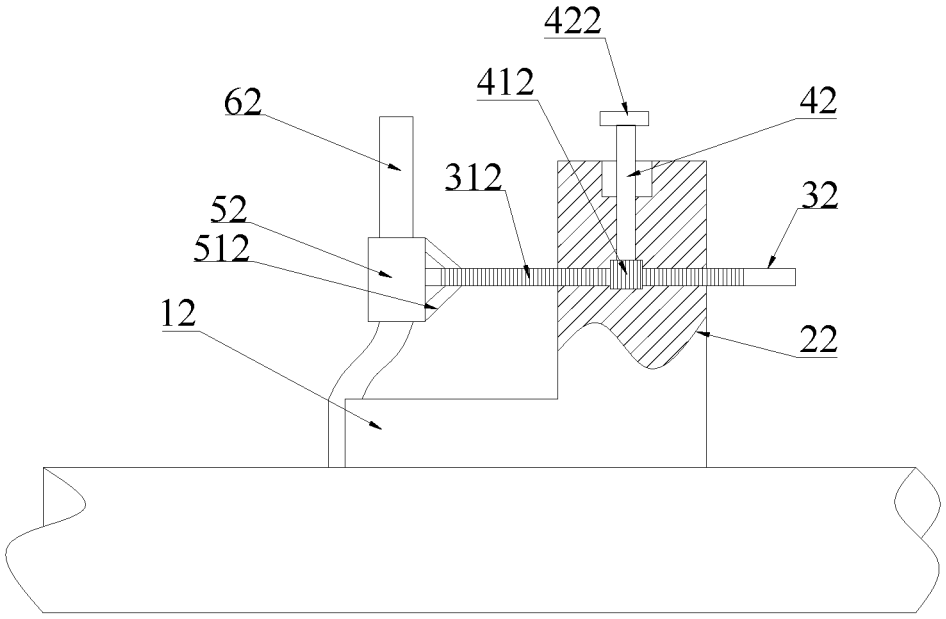
FIG. 20 is a structural schematic diagram showing the adjusted steel bar according to embodiment 7 of the present invention.

The specific operations are described below. First, the drive rod 42 is rotated to make the pull rod 32 move forward and the sleeve 52 away from the contacting end 112. Then, the sleeve 52 is sleeved around the steel bar 62, and the base 12 is dropped to the installation foundation surface. By rotating the drive rod 42 in the opposite direction, the pull rod 32 move backward and the contacting end 112 abuts against the steel bar 62. Subsequently, the operation handle 422 is rotated to make the pull rod 32 further move backward. By observing the ruler 322, when the pull rod 32 moves backward to the predetermined position, the rotation of the operation handle 422 is stopped. Under the counter force of the contacting end 112 and sleeve 52, the steel bar 62 is bent, and the upper part of the steel bar 62 is bent to the predetermined horizontal position, as shown in FIG. 20, thus the adjustment of the horizontal position of the steel bar 62 is realized.

The counter force exerted to the steel bar through the pull rod and the base makes the steel bar bent, so as to realize the adjustment of the horizontal position. The drive rod is vertically arranged to facilitate the operator to rotate the handle at the top, so the operation is more convenient and labor-saving. By betting an arc opening at the contacting end of the base, occurrence of the slippage and the misalignment which leads to the adjustment failure in the pressing process between the contacting end and the steel bar can be avoided.

A reinforcing rib is added at the connection part between the sleeve and the pull rod to improve the connection strength of them.

By setting the height difference between the sleeve and the base, a stress concentration section is reserved for the bending of steel bar, which is helpful in the bending operation.

The basic principle, main features, and advantages of the present invention are shown and described above. It should be noted by those of ordinary skill in the art that the present invention is not limited to the foregoing embodiments. The foregoing embodiments and the description in the specification are merely intended to illustrate the principle of the present invention. Various variations and improvements may be derived without departing from the spirit and scope of the present invention, and these variations and improvements should all be considered as falling within the scope of the present invention. The scope of the present invention is defined by the appended claims and the equivalents thereof.

We claim:

1. An assembling structure of prefabricated concrete component, comprising a half-grout sleeve and an alignment device; wherein the half-grout sleeve comprises a sleeve, a steel tube transition section, and a self-locking steel frame; wherein the sleeve comprises a non-grout connection section and a grout connection section; wherein a first section of tube body of the steel tube transition section is fixed in the non-grout connection section, and a second section of tube body of the steel tube transition section extends out of the non-grout connection section to form a rolling section connected to a first to-be-connceted steel bar by a rolling connection;

the self-locking steel frame comprises a plurality of longitudinal guide steel bars, a plurality of tilted steel branches, and a plurality of annular fixing steel rings; wherein the plurality of longitudinal guide steel bars and the plurality of annular fixing steel rings form a cylindrical keel; the plurality of tilted steel branches are circumferentially and radially arranged in the cylindrical keel and fixed slantwise; a first end of each of the plurality of tilted steel branches is located in the cylindrical keel to form an inner barbed structure; a plurality of inner barbed structures surround to form a channel for a second to-be-connceted steel bar to pass; a diameter of the channel is smaller than a diameter of the second to-be-connceted steel bar; a second end of each of the plurality of tilted steel branches is located outside the cylindrical keel to form an outer barbed structure; a diameter of a contour surrounded by the outer barbed structure is larger than a diameter of an inner chamber of the grout connection section;

when the self-locking steel frame is inserted into the grout connection section, the outer barbed structure closely contact an inner wall of the grout connection section; the channel is coaxial with the steel tube transition section;

the alignment device comprises a control mechanism, at least two sets of bearing mechanisms, and a positioning mechanism; wherein the bearing mechanism comprises a lower bearer and an upper bearer; both of the upper bearer and the lower bearer are electromagnets; the positioning mechanism comprises a first mark and a second mark respectively arranged at a corresponding position of an assembly surface between an upper concrete component and a lower concrete component; the lower bearer is placed at the first mark, and the upper bearer is placed at the second mark; same magnetic poles of the upper bearer and the lower bearer are oppositely arranged to generate a repulsive force;

the upper bearer and the lower bearer are connected in series on a same circuit;

the control mechanism controls a magnitude of the repulsive force between the upper bearer and the lower bearer by controlling the magnitude of the current of the circuit.

2. The assembling structure of the prefabricated concrete component according to claim 1, wherein the non-grout connection section is a truncated cone structure; the grout connection section is a cylindrical structure; a small diameter end of the non-grout connection section is connected to an end of the grout connection section, and a junction thereof has a fillet transition.

3. The assembling structure of the prefabricated concrete component according to claim 1, wherein a section of tube body of the steel tube transition section is connected and fixed with the non-grout connection section by the thread connection.

4. The assembling structure of the prefabricated concrete component according to claim 1, wherein an end of the grout connection section away from the non-grout connection section is provided with a grouting hole; the non-grout connection section is provided an exhaust hole (5110) connected to an inner chamber of the grout connection section.

5. The assembling structure of the prefabricated concrete component according to claim 1, wherein the inner wall of the grout connection section is provided with a spiral raised rib the spiral raised rib tilts from bottom to top toward a side away from the non-grout connection section a first side of the spiral raised rib away from the non-grout connection section is a concave arc surface, and a second side is a convex arc surface; a junction between the first side and the second side of the spiral raised rib and the inner wall of the grout connection section has a fillet transition.

6. The assembling structure of the prefabricated concrete component according to claim 1, wherein a plurality of anti-shear components are fixed in a cylinder wall of the grout connection section; the plurality of anti-shear components are simultaneously cured and fixed with the grouting material inside the grout connection section and concrete outside the grout connection section.

7. The assembling structure of the prefabricated concrete component according to claim 1, wherein the upper bearer comprises a support plate and a limit plate; the limit plate is vertically fixed at an end part of the support plate and forms an L-shaped structure with the support plate; the support plate is located on an assembly surface of the upper concrete component; and the limit plate is located on a side surface of the upper concrete component.

8. The assembling structure of the prefabricated concrete component according to claim 7, wherein the support plate and the lower bearer both have a hollow structure; an interior of the hollow structure is provided with a coil and an iron core passing through the coil; both of the support plate and the lower bearer are provided with an incoming line port and an outgoing line port; an input end and an output end of the coil are respectively connected to an external circuit through the incoming line port and the outgoing line port.

9. The assembling structure of the prefabricated concrete component according to claim 7, wherein two adjacent upper bearers and/or two adjacent lower bearers are connected to each other by a connection rod; and the connection rod is a retractable rod.

10. The assembling structure of the prefabricated concrete component according to claim 6, wherein opposite sides of two adjacent limit plates are respectively provided with an engaging slot; opposite sides of two adjacent lower bearers are respectively provided with an engaging slot; and two ends of the connection rod are respectively provided with an engaging key matched with the engaging slot.

11. The assembling structure of the prefabricated concrete component according to claim 2, wherein a section of tube body of the steel tube transition section is connected and fixed with the non-grout connection section by the thread connection.

12. The assembling structure of the prefabricated concrete component according to claim 2, wherein the end of the grout connection section away from the non-grout connection section is provided with a grouting hole; the non-grout connection section is provided an exhaust hole connected to an inner chamber of the grout connection section.

13. The assembling structure of the prefabricated concrete component according to claim 2, wherein the inner wall of the grout connection section is provided with a spiral raised rib;

the spiral raised rib tilts from bottom to top toward a side away from the non-grout connection section; a first side of the spiral raised rib away from the non-grout connection section is a concave arc surface, and a second side is a convex arc surface; a junction between the first side and the second side of the spiral raised rib and the inner wall of the grout connection section has a fillet transition.

14. The assembling structure of the prefabricated concrete component according to claim 2, wherein a plurality of anti-shear components are fixed in a cylinder wall of the grout connection section; the plurality of anti-shear components are simultaneously cured and fixed with the grouting material inside the grout connection section and concrete outside the grout connection section.

* * * * *